US011124732B2

(12) United States Patent
Sunagawa

(10) Patent No.: US 11,124,732 B2
(45) Date of Patent: Sep. 21, 2021

(54) LUBRICANT COMPOSITION

(71) Applicant: IDEMITSU KOSAN CO., LTD., Chiyoda-ku (JP)

(72) Inventor: Yoji Sunagawa, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/562,204

(22) PCT Filed: Mar. 23, 2016

(86) PCT No.: PCT/JP2016/059250

§ 371 (c)(1),
(2) Date: Sep. 27, 2017

(87) PCT Pub. No.: WO2016/158622

PCT Pub. Date: Oct. 6, 2016

(65) Prior Publication Data

US 2018/0119051 A1 May 3, 2018

(30) Foreign Application Priority Data

Mar. 30, 2015 (JP) ..... JP2015-070144

(51) Int. Cl.

| | |
|---|---|
| ***C10M 169/04*** | (2006.01) |
| ***C10M 139/00*** | (2006.01) |
| ***C10M 161/00*** | (2006.01) |
| ***C10M 105/32*** | (2006.01) |
| ***C10M 107/02*** | (2006.01) |
| ***C10M 111/04*** | (2006.01) |
| ***C10M 133/06*** | (2006.01) |
| ***C10M 135/04*** | (2006.01) |
| ***C10M 135/22*** | (2006.01) |
| ***C10M 137/02*** | (2006.01) |
| ***C10M 137/08*** | (2006.01) |
| ***C10M 137/10*** | (2006.01) |
| ***C10M 143/04*** | (2006.01) |

(Continued)

(52) U.S. Cl.

CPC ..... *C10M 169/044* (2013.01); *C10M 105/32* (2013.01); *C10M 107/02* (2013.01); *C10M 111/04* (2013.01); *C10M 133/06* (2013.01); *C10M 135/04* (2013.01); *C10M 135/22* (2013.01); *C10M 137/02* (2013.01); *C10M 137/08* (2013.01); *C10M 137/10* (2013.01); *C10M 139/00* (2013.01); *C10M 143/04* (2013.01); *C10M 161/00* (2013.01); *C10M 135/00* (2013.01); *C10M 137/00* (2013.01); *C10M 143/00* (2013.01); *C10M 2205/024* (2013.01); *C10M 2205/0206* (2013.01); *C10M 2207/2805* (2013.01); *C10M 2215/26* (2013.01); *C10M 2219/022* (2013.01); *C10M 2219/082* (2013.01); *C10M 2223/043* (2013.01); *C10M 2223/047* (2013.01); *C10M 2223/049* (2013.01); *C10M 2227/00* (2013.01); *C10M 2227/066* (2013.01); *C10N 2030/06* (2013.01); *C10N 2040/04* (2013.01)

(58) Field of Classification Search

CPC ..... C10N 2020/02; C10M 169/044; C10M 105/32; C10M 107/02; C10M 111/04; C10M 133/06; C10M 135/04; C10M 135/22; C10M 137/02; C10M 137/08; C10M 137/10; C10M 143/04; C10M 139/00; C10M 161/00

USPC ..... 508/192

See application file for complete search history.

(56) References Cited

U.S. PATENT DOCUMENTS

| | | | | |
|---|---|---|---|---|
| 9,376,645 | B2 * | 6/2016 | Yaguchi | C10M 169/042 |
| 2003/0148895 | A1 | 8/2003 | Robson et al. | |

(Continued)

FOREIGN PATENT DOCUMENTS

| | | | |
|---|---|---|---|
| CN | 101003763 | A | 7/2007 |
| CN | 1306918 | A | 8/2011 |

(Continued)

OTHER PUBLICATIONS

International Search Report dated Apr. 26, 2016 in PCT/JP2016/059250 filed Mar. 23, 2016.

(Continued)

*Primary Examiner* — Ellen M McAvoy

(74) *Attorney, Agent, or Firm* — Oblon, McClelland, Maier & Neustadt, L.L.P.

(57) ABSTRACT

Disclosed is a lubricating oil composition containing a base oil, a viscosity index improver, a molybdenum-based friction modifier, a boron-containing dispersant, and at least two extreme-pressure additives selected from a sulfur-based extreme-pressure additive, a phosphorous-based extreme-pressure additive and a sulfur/phosphorus-based extreme-pressure additive, or a sulfur/phosphorus-based extreme-pressure additive. The base oil is a synthetic oil having a kinematic viscosity at 100° C. of 3 $mm^2/s$ or more and 10 $mm^2/s$ or less, the viscosity index improver is a resin having a number average molecular weight (Mn) of 1,000 or more and 10,000 or less, the mass ratio of boron atoms (B) contained in the boron-containing dispersant to molybdenum atoms (Mo) contained in the molybdenum-based friction modifier, [(B)/(Mo)] is 1 or more and 5 or less, and the mass ratio of sulfur atoms (S) to phosphorus atoms (P) contained in the extreme-pressure additive(s), [(S)/(P)] is 10 or more and 20 or less.

10 Claims, No Drawings

(51) Int. Cl.

| | |
|---|---|
| *C10M 135/00* | (2006.01) |
| *C10M 137/00* | (2006.01) |
| *C10M 143/00* | (2006.01) |
| *C10N 30/06* | (2006.01) |
| *C10N 40/04* | (2006.01) |

(56) References Cited

U.S. PATENT DOCUMENTS

| | | | | |
|---|---|---|---|---|
| 2003/0166477 | A1 | 9/2003 | Abraham et al. | |
| 2007/0142237 | A1* | 6/2007 | DeGonia | C10M 141/12 508/187 |
| 2008/0020952 | A1* | 1/2008 | Yagishita | C10M 139/00 508/186 |
| 2008/0110799 | A1* | 5/2008 | Matsui | C10M 169/04 208/19 |
| 2009/0082233 | A1* | 3/2009 | Kasai | C10M 163/00 508/174 |
| 2012/0040874 | A1* | 2/2012 | Toda | C10M 169/044 508/364 |
| 2012/0316094 | A1* | 12/2012 | Givens | C10M 111/04 508/591 |
| 2013/0184191 | A1* | 7/2013 | Lee | C10M 171/02 508/591 |
| 2014/0113847 | A1* | 4/2014 | Givens | C10M 169/041 508/468 |
| 2014/0187457 | A1* | 7/2014 | Kanga | C10M 149/04 508/464 |
| 2014/0274848 | A1* | 9/2014 | Young | C10M 171/002 508/506 |
| 2014/0342958 | A1* | 11/2014 | Kubo | C10M 169/04 508/364 |
| 2015/0051127 | A1* | 2/2015 | Komatsubara | C10M 141/10 508/272 |
| 2016/0040095 | A1 | 2/2016 | Fujii et al. | |
| 2016/0075964 | A1* | 3/2016 | Komatsubara | C10M 163/00 508/192 |
| 2016/0340603 | A1* | 11/2016 | Takahashi | C10M 169/04 |
| 2018/0112148 | A1* | 4/2018 | Bouvier | C10M 111/04 |

FOREIGN PATENT DOCUMENTS

| | | | | |
|---|---|---|---|---|
| CN | 102171320 | A | 8/2011 | |
| CN | 102300970 | A | 12/2011 | |
| CN | 102365354 | A | 2/2012 | |
| EP | 0531000 | A1 * | 3/1993 | C10M 141/08 |
| EP | 2 975 104 | A1 | 1/2016 | |
| JP | 63-280796 | A | 11/1988 | |
| JP | 7-331269 | A | 12/1995 | |
| JP | 8-283762 | A | 10/1996 | |
| JP | 11-323370 | A | 11/1999 | |
| JP | 2003-155495 | A | 5/2003 | |
| JP | 2005-517798 | A | 6/2005 | |
| JP | 2011-174000 | A | 9/2011 | |
| WO | WO 2006/126651 | A1 | 11/2006 | |
| WO | WO 2009/118984 | A1 | 10/2009 | |
| WO | WO 2014/142230 | A1 | 9/2014 | |

OTHER PUBLICATIONS

Extended European Search Report dated Jul. 11, 2018 in European Patent Application No. 16772503.5, 7 pages.

Combined Chinese Office Action and Search Report dated Apr. 2, 2020 in Chinese Patent Application No. 201680019763.8 (with unedited computer generated English translation and English translation of Category of Cited Documents), 33 pages.

Chinese Office Action dated Feb. 2, 2021 in Chinese Patent Application No. 201680019763.8, 12 pages.

* cited by examiner

LUBRICANT COMPOSITION

TECHNICAL FIELD

The present invention relates to a lubricating oil composition.

BACKGROUND ART

A lubricating oil composition is used in various fields, and is used, for example, for internal combustion engines for use in gasoline engines, diesel engines and other internal combustion engines, or for use for gear systems, etc. The properties required in common for these uses include fuel saving properties, which are improved by reducing friction coefficient or traction coefficient. For example, PTL 1 discloses a lubricating oil composition attaining a friction loss reduction and having excellent fuel saving properties which is prepared by blending a poly-α-olefin (PAO) in a base oil.

In addition to the common performance of fuel saving properties, the lubricating oil composition is further required to have specific properties in accordance with the use thereof. For example, a lubricating oil composition for gear systems is further divided into various uses for automobiles and other high-speed high-load gears, for relatively low-load gears for ordinary machineries, for relatively high-load gears for ordinary machineries, etc., and is used for preventing damages and seizing of gears.

The lubricating oil composition for such gear systems is generally required to be excellent in extreme-pressure properties. For example, PTLs 2 and 3 each disclose a lubricating oil composition containing a specific ethylene-α-olefin copolymer and being excellent in extreme-pressure properties.

CITATION LIST

Patent Literature

PTL 1: JP 2011-174000 A
PTL 2: JP 63-280796 A
TL 3: JP 11-323370 A

SUMMARY OF INVENTION

Technical Problem

However, fuel saving properties and extreme-pressure properties are contradictory properties, and are difficult to satisfy at the same time. As a method for enhancing fuel saving properties, for example, the use of a gear oil having a low viscosity may be considered for decreasing the viscosity resistance, but the method may suffer shortage of an oil film, thereby deteriorating the seizing resistance, which causes additional problems, e.g., deterioration of extreme pressure property and deterioration of the fatigue life of the bearing and gear. Further, owing to shortage of an oil film, contact frequency of gear surfaces may increase, thereby increasing friction loss.

In addition, in the case where a lubricating oil composition is used in gear systems, shear stability, oxidation stability and wear resistance are required in addition to fuel saving properties and extreme-pressure properties. Like this, technical development for a lubricating oil composition capable of satisfying both fuel saving properties and extreme-pressure properties and further having excellent shear stability, oxidation stability and wear resistance is desired.

The present invention has been made in consideration of the above-mentioned situation, and its object is to provide a lubricating oil composition having shear stability, oxidation stability and wear resistance while satisfying both fuel saving properties and extreme-pressure properties.

Solution to Problem

The present inventors have assiduously studied and, as a result, have found that, by combining a specific base oil and a specific additive, the above-mentioned problems can be solved. The present invention has been completed on the basis of this finding.

Specifically, the present invention provides a lubricating oil composition containing a base oil, a viscosity index improver, a molybdenum-based friction modifier, a boron-containing dispersant, and at least two extreme-pressure additives selected from a sulfur-based extreme-pressure additive, a phosphorous-based extreme-pressure additive and a sulfur/phosphorus-based extreme-pressure additive, or a sulfur/phosphorus-based extreme-pressure additive, wherein the base oil is formed of only a synthetic oil, the kinematic viscosity of the base oil at 100° C. is 3 $mm^2/s$ or more and 10 $mm^2/s$ or less, the viscosity index improver is a resin having a number average molecular weight (Mn) of 1,000 or more and 10,000 or less, the mass ratio of the boron atoms (B) contained in the boron-containing dispersant to the molybdenum atoms (Mo) contained in the molybdenum-based friction modifier, [(B)/(Mo)] is 1 or more and 5 or less, and the mass ratio of the sulfur atoms (S) to the phosphorus atoms (P) contained in the extreme-pressure additive(s), [(S)/(P)] is 10 or more and 20 or less.

Advantageous Effects of Invention

According to the present invention, there can be provided a lubricating oil composition satisfying both fuel saving properties and extreme-pressure properties, and further having shear stability, oxidation stability and wear resistance.

DESCRIPTION OF EMBODIMENTS

The lubricating oil composition of the present invention is described below. In this description, the numerical values of "X or more" and "Y or less" relating to the description of a numerical range are numerical values that can be combined in any manner. In this description, the numerical range expressed by "X to Y" indicates a range that includes the numerical value X or the numerical Y as the minimum value or the maximum value, and the minimum value and the maximum value thus stepwise expressed may be combined in any manner.

The lubricating oil composition of the present invention contains a base oil, a viscosity index improver, a molybdenum-based friction modifier, a boron-containing dispersant, and at least two extreme-pressure additives selected from a sulfur-based extreme-pressure additive, a phosphorous-based extreme-pressure additive and a sulfur/phosphorus-based extreme-pressure additive, or a sulfur/phosphorus-based extreme-pressure additive, wherein the base oil is formed of only a synthetic oil, the kinematic viscosity of the base oil at 100° C. is 3 $mm^2/s$ or more and 10 $mm^2/s$ or less, the viscosity index improver is a resin having a number average molecular weight (Mn) of 1,000 or more and 10,000 or less, the mass ratio of the boron atoms (B) contained in the boron-containing dispersant to the molybdenum atoms (Mo) contained in the molybdenum-based friction modifier, [(B)/(Mo)] is 1 or more and 5 or less, and the mass ratio of the sulfur atoms (S) to the phosphorus atoms (P) contained in the extreme-pressure additive(s), [(S)/(P)] is 10 or more and 20 or less.

(Base Oil)

The base oil for use in the present invention is formed of a synthetic oil alone, and does not contain a mineral oil. When the base oil contains a mineral oil, the traction coefficient thereof becomes large and, as a result, the composition could not have fuel saving properties.

Examples of the synthetic oil include polyphenyl ethers, alkylbenzenes, alkylnaphthalenes, ester oils, glycol-based or polyolefin-based synthetic oils, etc., and more specifically, include poly-α-olefins (PAO), ethylene-α-olefin copolymers, polybutenes, alkylbenzenes, alkylnaphthalenes, polyalkylene glycols, polyphenyl ethers, alkyl-substituted diphenyl ethers, polyol esters, dibasic acid esters, carbonates, silicone oils, fluorinated oils, GTL (gas-to-liquid fuels), etc.

In the present invention, among the above, poly-α-olefins, ester oils and polyolefin-based synthetic oils are preferred, poly-α-olefins (PAO), ethylene-α-olefin copolymers, polyol esters, dibasic acid esters, carbonates and GTL (gas-to-liquid fuels) are more preferred, and poly-α-olefins (PAO) are even more preferred. In the present invention, as the base oil, one or plural kinds of the above-mentioned synthetic oils may be used either singly or as combined.

The synthetic oil for use as the base oil in the present invention must have a kinematic viscosity at 100° C. of 3 $mm^2/s$ or more and 10 $mm^2/s$ or less. When the kinematic viscosity of the base oil is less than 3 $mm^2/s$, the composition cannot have oxidation stability, but on the other hand, when more than 10 $mm^2/s$, the power loss increases and the composition could not have fuel saving properties. From the viewpoint of realizing excellent fuel saving properties and oxidation stability, the kinematic viscosity is preferably 3 $mm^2/s$ or more and 8 $mm^2/s$ or less, more preferably 3 $mm^2/s$ or more and 6 $mm^2/s$ or less.

From the viewpoint of fuel saving properties, the base oil is preferably one having a viscosity index of 120 or more, more preferably 125 or more, even more preferably 130 or more. The kinematic viscosity and the viscosity index of the lubricating oil composition are values measured using a glass capillary viscometer according to JIS K 2283:2000.

The content of the base oil is preferably 60% by mass or more based on the total amount of the lubricating oil composition, more preferably 70% by mass or more, even more preferably 75% by mass or more, and is preferably 99% by mass or less, more preferably 95% by mass or less.

(Viscosity Index Improver)

The lubricating oil composition of the present invention contains a resin having a number average molecular weight (Mn) of 1,000 or more and 10,000 or less, as a viscosity index improver. Examples of the resin include poly(meth) acrylates (dispersive, non-dispersive), olefin copolymers (dispersive, non-dispersive), styrene copolymers (for example, styrene-diene copolymers, styrene-isoprene copolymers, etc.), etc. In the present invention, olefin copolymers are preferred from the viewpoint of shear stability.

Examples of the olefin copolymers include copolymers of olefin having 2 to 20 carbon atoms, preferably 2 to 16 carbon atoms, more preferably 2 to 14 carbon atoms, and copolymers of ethylene and α-olefin are preferred. Examples of the ethylene-α-olefin copolymer include copolymers of 15 to 80 mol % of ethylene with an α-olefin having 3 to 20 carbon atoms such as propylene, 1-butene, 1-decene, etc., and may be random-form or block-form copolymers.

The copolymers are non-dispersive in lubricating oil, but dispersive ones prepared by grafting the ethylene-α-olefin copolymer with maleic acid, N-vinylpyrrolidone, N-vinylimidazole, glycidyl acrylate or the like are also usable.

The viscosity index improver has a number average molecular weight (Mn) of 1,000 or more and 10,000 or less. When the number average molecular weight (Mn) is less than 1,000, the viscosity index improving effect (fuel saving properties) could not be realized sufficiently, but when more than 10,000, shear stability could not be realized. From the viewpoint of realizing the viscosity index improving effect and shear stability, the number average molecular weight (Mn) of the viscosity index improver is preferably 1,000 or more and 8,000 or less, more preferably 1,300 or more and 6,000 or less, even more preferably 1,500 or more and 5,500 or less. In the present invention, an olefin copolymer having a low number average molecular weight (Mn) falling within the above range is especially preferred from the viewpoint of fuel saving properties and shear stability.

The content of the viscosity index improver is, from the viewpoint of fuel saving properties and shear stability, preferably 0.5% by mass or more and 15% by mass or less based on the total amount of the lubricating oil composition, more preferably 1% by mass or more and 10% by mass or less, even more preferably 1.5% by mass or more and 8% by mass or less.

(Molybdenum-Based Friction Modifier)

The lubricating oil composition of the present invention contains a molybdenum-based friction modifier. The molybdenum-based friction modifier may be any compound generally used as a friction modifier for lubricating oils for internal combustion engines, and is, for example, at least one selected from molybdenum-amine complexes and/or oxymolybdenum sulfide dithiocarbamates, trinulcear molybdenum-sulfur compounds, and molybdenum dithiophosphates. More specifically, from the viewpoint of lowering intermetallic friction coefficient to realize excellent fuel saving properties, at least one selected from molybdenum dithiocarbamate (MoDTC), molybdenum dithiophosphate (MoDTP) and an amine salt of molybdic acid is preferably used. In the present invention, in particular, molybdenum dithiocarbamate (MoDTC) is preferred.

Preferred examples of the molybdenum dithiocarbamate (MoDTC) include those represented by the following general formula (1).

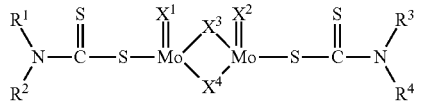

(1)

In the above general formula (1), $R^1$ to $R^4$ each independently represent a hydrocarbon group having 5 to 18 carbon atoms, and may be the same as or different from each other.

$X^1$ to $X^4$ each independently represent an oxygen atom or a sulfur atom, and may be the same as or different from each other. From the viewpoint of improving solubility in base oil, the molar ratio of the sulfur atoms to the oxygen atoms in $X^1$ to $X^4$ [sulfur atoms/oxygen atoms] is preferably 1/3 to 3/1, more preferably 1.5/2.5 to 3/1.

Examples of the hydrocarbon group of $R^1$ to $R^4$ include an alkyl group having 5 to 18 carbon atoms such as a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, etc.; an alkenyl group having 5 to 18 carbon atoms such as an octenyl group, a nonenyl group, a decenyl group, an undecenyl group, a dodecenyl group, a tridecenyl group, a tetradecenyl group, a pentadecenyl group, etc.; a cycloalkyl group having 5 to 18 carbon atoms such as a cyclohexyl group, a dim ethylcyclohexyl group, an ethylcyclohexyl group, a methylcyclohexylmethyl group, a cyclohexylethyl group, a propylcyclohexyl group, a butylcyclohexyl group, a heptylcyclohexyl group, etc.; an aryl group having 6 to 18 carbon atoms such as a phenyl group, a naphthyl group, an anthracenyl group, a biphenyl group, a terphenyl group, etc.; an alkylaryl group such as a tolyl group, a dimethylphenyl group, a butylphenyl group, a nonylphenyl group, a methylbenzyl group, a dimethylnaphthyl group, etc.; an arylalkyl group having 7 to 18 carbon atoms such as a phenylmethyl group, a phenylethyl group, a diphenylmethyl group, etc. In the present invention, among the above-mentioned hydrocarbon groups, those having an upper limit of the carbon number of 16 are preferred, and those having a carbon number of 12 are more preferred.

The content of the molybdenum-based friction modifier is, from the viewpoint of lowering intermetallic friction coefficient to realize excellent fuel saving properties, preferably 0.05% by mass or more and 5% by mass or less based on the total amount of the lubricating oil composition, more preferably 0.1% by mass or more and 3% by mass or less, even more preferably 0.2% by mass or more and 1.5% by mass or less. The molybdenum atom-equivalent content of the molybdenum-based friction modifier is preferably 0.005% by mass or more and 0.1% by mass or less based on the total amount of the lubricating oil composition. From the viewpoint of maintaining wear resistance, the content is more preferably 0.007% by mass or more and 0.1% by mass or less, even more preferably 0.01% by mass or more and 0.08% by mass or less.

In the present invention, any other friction modifier than the molybdenum-based friction modifier can be used. Examples of the other friction modifier than the molybdenum-based friction modifier include ash-free friction modifiers such as aliphatic amine, fatty acid esters, fatty acid amides, fatty acids, aliphatic alcohols, and aliphatic ethers and the like having at least one alkyl or alkenyl group with 6 to 30 carbon atoms, especially at least one linear alkyl or linear alkenyl group with 6 to 30 carbon atoms in the molecule. One of them may be used soley or plural kinds thereof may be used in combination.

The content of the friction modifier is preferably 0.05% by mass or more and 5% by mass or less based on the total amount of the lubricating oil composition, more preferably 0.1% by mass or more and 3% by mass or less, even more preferably 0.2% by mass or more and 1.5% by mass or less.

(Boron-Containing Dispersant)

The lubricating oil composition of the present invention contains a boron-containing dispersant. Examples of the boron-containing dispersant include a boron-containing imide-based dispersant. The boron-containing imide-based dispersant is preferably a boron-containing succinimide. The boron-containing succinimide includes a boride of a mono-type succinimide represented by the following general formula (2) and a boride of a bis-type succinimide represented by (3).

(2)

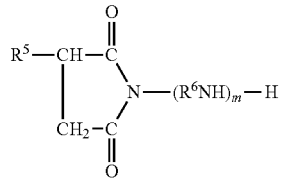

(3)

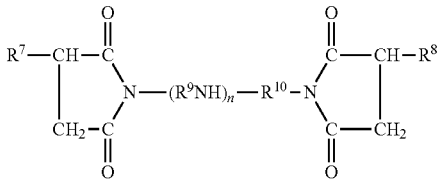

In the above general formulae (2) and (3), $R^5$, $R^7$ and $R^8$ each represent an alkenyl or alkyl group having a number average molecular weight of 500 or more and 4,000 or less, and $R^7$ and $R^8$ may be the same or different. The number average molecular weight of $R^5$, $R^7$ and $R^8$ is preferably 1,000 or more and 4,000 or less.

When the number average molecular weight of the above $R^5$, $R^7$ and $R^8$ is 500 or more, solubility in base oil is good, and when 4,000 or less, good dispersibility can be realized and excellent detergency can be realized.

$R^6$, $R^9$ and $R^{10}$ each represent an alkylene group having 2 to 5 carbon atoms, and $R^9$ and $R^{10}$ may be the same or different.

m represents an integer of 1 to 10, preferably an integer of 2 to 5, more preferably 3 or 4. When m is 1 or more, dispersibility is good, and when m is 10 or less, solubility in base oil is good and excellent detergency can be realized. n represents an integer of 0 to 10, preferably an integer of 1 to 4, more preferably 2 or 3. n falling within the range is preferred from the viewpoint of dispersibility and solubility in base oil, therefore realizing excellent detergency.

The boron-containing succinimide can be produced generally by reacting an alkenylsuccinic anhydride obtained through reaction of a polyolefin and maleic anhydride, or an alkylsuccinic anhydride obtained through hydrogenation of the alkenylsuccinic anhydride, with a polyamine and a boron compound. A mono-type boron-containing succinimide compound and a bis-type boron-containing succinimide compound can be produced by varying the reaction ratio of the alkenylsuccinic anhydride or the alkylsuccinic anhydride and the polyamine.

The polyamine includes simple diamines such as ethylenediamine, propylene diamine, butylenediamine, etc.; polyalkylenepolyamines such as diethylenetriamine, triethylenetetramine, tetraethylenepentamine, pentaethylenehexamine, di(methylethylene)triamine, dibutylenetriamine, tributylenetetramine, etc.; piperazine derivatives such as aminoethylpiperazine, etc.

Examples of the boron compound include boron oxide, boron halides, boric acid, boric anhydride, borates, ammonium borate, etc.

The mass ratio of the boron content B to the nitrogen content N in the boron-containing succinimide, B/N is, in general, preferably 0.1 to 3, more preferably 0.2 to 1.

The content of the boron-containing dispersant is, in consideration of detergency, preferably 0.1% by mass or more and 10% by mass or less based on the total amount of the lubricating oil composition, more preferably 0.3% by mass or more and 8% by mass or less, even more preferably 0.5% by mass or more and 5% by mass or less, and the boron atom-equivalent content of the boron-containing dispersant is preferably 0.01% by mass or more and 0.1% by mass or less based on the total amount of the lubricating oil composition, more preferably 0.015% by mass or more and 0.08% by mass or less.

(Extreme-Pressure Additive)

The lubricating oil composition of the present invention contains, as an extreme-pressure additive, at least two extreme-pressure additives selected from a sulfur-based extreme-pressure additive, a phosphorous-based extreme-pressure additive and a sulfur/phosphorus-based extreme-pressure additive, or a sulfur/phosphorus-based extreme-pressure additive. These extreme-pressure additives contribute toward improving the intrinsic performance, extreme-pressure properties, but in the constitution of the present invention, it also contributes toward improving wear resistance.

Specifically, in the present invention, from the viewpoint of realizing excellent extreme-pressure properties and wear resistance, it is important to use, as an extreme-pressure additive, a sulfur-containing extreme-pressure additive and a phosphorus-containing extreme-pressure additive as combined, and for example, in the case of using a sulfur-based extreme-pressure additive, a phosphorus-based extreme-pressure additive and/or a sulfur/phosphorus-based extreme-pressure additive is used as combined, in the case where a phosphorus-based extreme-pressure additive is/are used, a sulfur-based extreme-pressure additive and/or sulfur/phosphorus-based extreme-pressure additive is/are used as combined, in the case where a sulfur-phosphorus-based extreme-pressure additive is used, it may be used alone or may be used as combined with a sulfur-based extreme-pressure additive and/or a phosphorus-based extreme-pressure additive.

Examples of the sulfur-based extreme-pressure additive include sulfurized oils and fats, sulfurized fatty acids, sulfurized esters, sulfurized olefins, monosulfides, polysulfides, dihydrocarbyl polysulfides, thiadiazole compounds, alkylthiocarbamoyl compounds, thiocarbamate compounds, thioterpene compounds, dialkylthio dipropionate compounds, etc. One of them may be used alone or plural kinds thereof may be used in combination. Among these, from the viewpoint of extreme-pressure properties and wear resistance, sulfurized olefins obtained through reaction of, for example, an olefin having 2 to 15 carbon atoms (or a dimer to tetramer thereof) with sulfur or a sulfurizing agent such as sulfur chloride, etc.; monosulfides such as dialkyl monosulfides, e.g., dibutyl monosulfide, dihexyl monosulfide, diheptyl monosulfide, dilauroyl monosulfide, ditetradecyl monosulfide, etc.; polysulfides corresponding to the monosulfides; and in addition, dihydrocarbyl polysulfides such as, for example, dibenzyl polysulfide, diphenyl polysulfide, dicyclohexyl polysulfide, etc.

Examples of the phosphorus-based extreme-pressure additive include phosphates such as aryl phosphates, alkyl phosphates, alkenyl phosphates, alkylaryl phosphates, etc.; acidic phosphates corresponding thereto; phosphites such as arylhydrogen phosphites, alkylhydrogen phosphites, aryl phosphites, alkyl phosphites, arylalkyl phosphites, etc.; acidic phosphites corresponding thereto; and amine salts thereof. One of them may be used alone or plural kinds thereof may be used in combination. Among these, from the viewpoint of extreme-pressure properties and wear resistance, aryl phosphates, aryl phosphites, arylalkyl phosphites and acidic alkyl phosphites are preferred; and specifically, tricresyl phosphate (TCP), tri(nonylphenyl) phosphite, dioleylhydrogen phosphite and 2-ethylhexyliphenyl phosphite are more preferred, and tricresyl phosphate (TCP) is especially preferred.

The sulfur/phosphorus-based extremely additive includes monothiophosphates, dithiophosphates, trithiophosphates, amine salts of monothiophosphates, amine salts of dithiophosphates, monothiophosphites, dithiophosphites, trithiophosphites, etc. One of them may be used alone or plural kinds thereof may be used in combination. Among these, from the viewpoint of extreme-pressure properties and wear resistance, dithiophosphates such as dialkyl dithiophosphates and diaryl dithiophosphates, e.g., dihexyl dithiophosphate, dioctyl dithiophosphate, di(octylthioethyl)dithiophosphate, dicyclohexyl dithiophosphate, dioleyl dithiophosphate, diphenyl dithiophosphate, dibenzyl dithiophosphate and the like are preferred.

The content of the sulfur-based extreme-pressure additive is, from the viewpoint of realizing excellent extreme-pressure properties and wear resistance, preferably 0.5% by mass or more and 10% by mass or less based on the total amount of the lubricating oil composition, more preferably 1% by mass or more and 8% by mass or less, even more preferably 2% by mass or more and 7% by mass or less.

The content of the phosphorus-based extreme-pressure additive is, from the viewpoint of realizing excellent extreme-pressure properties and wear resistance, preferably 0.1% by mass or more and 10% by mass or less based on the total amount of the lubricating oil composition, more preferably 0.5% by mass or more and 8% by mass or less, even more preferably 0.5% by mass or more and 3% by mass or less.

The content of the sulfur/phosphorus-based extreme-pressure additive is, from the viewpoint of realizing excellent extreme-pressure properties and wear resistance, preferably 0.1% by mass or more and 10% by mass or less based on the total amount of the lubricating oil composition, more preferably 0.5% by mass or more and 8% by mass or less, even more preferably 0.5% by mass or more and 3% by mass or less.

(Mass Ratio of Various Atoms)

In the lubricating oil composition of the present invention, the mass ratio of the boron atoms (B) contained in the boron-containing dispersant to the molybdenum atoms (Mo) contained in the molybdenum-based friction modifier, [(B)/(Mo)] is 1 or more and 5 or less. When the mass ratio of the boron atoms (B) to the molybdenum atoms (Mo) [(B)/(Mo)] falls without the above range, the intermetallic friction coefficient may be too large and excellent fuel saving properties could not be realized. From the viewpoint of realizing excellent fuel saving properties, the mass ratio of the boron atoms (B) to the molybdenum atoms (Mo) [(B)/(Mo)] is preferably 1 or more and 4.5 or less, more preferably 1 or more and 3 or less.

In the lubricating oil composition of the present invention, the mass ratio of the sulfur atoms (S) to the phosphorus atoms (P) contained in the extreme-pressure additive(s), [(S)/(P)] is 10 or more and 20 or less. When the mass ratio of the sulfur atoms (S) to the phosphorus atoms (P), [(S)/(P)] is less than 10, excellent extreme-pressure properties could not be realized, but on the other hand, when more than 20, excellent wear resistance could not be realized. From the viewpoint of realizing excellent extreme-pressure properties and wear resistance, the mass ratio of the sulfur atoms (S) to the phosphorus atoms (P), [(S)/(P)] is preferably 10 or more and 18 or less, more preferably 10 or more and 17 or less.

The content of the sulfur atoms based on the total weight of the lubricating oil composition is preferably 1.5% by mass or more and 5.0% by mass or less, more preferably 1.5% by mass or more and 3.0% by mass or less, even more preferably 1.7% by mass or more and 2.5% by mass or less. When the content of the sulfur atoms falls within the above range, excellent extreme-pressure properties can be realized.

The content of the phosphorus atoms based on the total weight of the lubricating oil composition is preferably 0.1% by mass or more and 0.5% by mass or less, more preferably 0.1% by mass or more and 0.3% by mass or less, even more preferably 0.1% by mass or more and 0.2% by mass or less. When the content of the phosphorus atoms falls within the above range, excellent extreme-pressure properties and wear resistance can be realized.

(Other Additives)

Any other additives may be optionally added to the lubricating oil composition of the present invention within a range not contradictory to the object of the present invention. Examples of the additives include antioxidant, ash-free dispersant, metallic detergent, pour point depressant, metal deactivator, rust inhibitor, defoaming agent, etc.

Examples of the antioxidant include amine-based antioxidants, phenolic antioxidants, molybdenum-based antioxidants, sulfur-based antioxidants, phosphorus-based antioxidants, etc.

Examples of the amine-based antioxidants include diphenylamine-based antioxidants such as diphenylamine, alkyldiphenylamine having an alkyl group with 3 to 20 carbon atoms, etc.; naphthylamine-based antioxidants such as α-naphthylamine, alkyl-substituted phenyl-α-naphthylamine having 3 to 20 carbon atoms, etc.

Examples of the phenolic antioxidants include monophenolic antioxidants such as 2,6-di-tert-butyl-4-methylphenol, 2,6-di-tert-butyl-4-ethylphenol, octadecyl 3-(3,5-di-tert-butyl-4-hydroxyphenyl)propionate, etc.; diphenolic antioxidants such as 4,4'-methylenebis(2,6-di-tert-butylphenol), 2,2'-methylenebis(4-ethyl-6-tert-butylphenol), etc.; hindered phenolic antioxidants, etc.

Examples of the molybdenum-based antioxidants include molybdenum-amine complexes prepared through reaction of molybdenum trioxide and/or molybdic acid with an amine compound, etc.

Examples of the sulfur-based antioxidants include phenothiazine, dioctadecyl sulfide, dilauryl 3,3'-thiodipropionate, 2-mercaptobenzimidazole, etc.

Examples of the phosphorus-based antioxidants include phosphites such as triphenyl phosphite, trisnonylphenyl phosphite, diisopropylmonophenyl phosphite, monobutykliphenyl phosphite, etc.

One of these antioxidants may be used alone or plural kinds thereof may be used in combination, and in general, it is preferred to use plural kinds thereof in combination.

One of the antioxidants may be used alone or plural kinds thereof may be used in combination. For example, from the viewpoint of the effect of oxidation stability, a mixture of one or more kinds of phenolic antioxidants and one or more kinds of amine-based antioxidants is preferred.

The blending amount of the antioxidant is, in general, preferably 0.1% by mass or more and 5% by mass or less based on the total amount of the lubricating oil composition, more preferably 0.1% by mass or more and 3% by mass or less.

The ash-free dispersant includes other ash-free dispersants than the above-mentioned boron-containing succinimides, for example, boron-free succinimides, benzylamines, boron-containing benzylamines, succinates, mono or dicarboxylic acid amides with typically fatty acids or succinic acid, etc.

Examples of the metallic detergent include neutral metal sulfonates, neutral metal phenates, neutral metal salicylates, neutral metal phosphonates, basic metal sulfonates, basic metal phenates, basic metal salicylates, overbased (for example, the total base number is 20 to 700 mgKOH/g) metal sulfonates, overbased metal salicylates, overbased metal phenates and the like with alkaline earth metals such as calcium, etc. The blending amount of the ash-free dispersant and the metallic detergent is generally 0.1% by mass or more and 20% by mass or less based on the total amount of the lubricating oil composition, preferably 0.5% by mass or more and 10% by mass or less.

Examples of the pour point depressant includes polymethacrylates having a weight average molecular weight of approximately 5,000 or more and 50,000 or less.

The blending amount of the pour point depressant is, from the viewpoint of the blending effect, generally approximately 0.1% by mass or more and 2% by mass or less based on the total amount of the lubricating oil composition, preferably 0.1% by mass or more and 1% by mass or less.

The metal deactivator includes benzotriazole-type, tolyltriazole-type, thiadiazole-type and imidazole-type compounds, etc.

The blending amount of the metal deactivator is generally 0.01% by mass or more and 3% by mass or less based on the total amount of the lubricating oil composition, preferably 0.01% by mass or more and 1% by mass or less.

The rust inhibitor includes petroleum sulfonates, alkylbenzene sulfonates, dinonylnaphthalene sulfonates, alkenylsuccinates, polyalcohol esters, etc.

The blending amount of the rust inhibitor is, from the viewpoint of the blending effect, generally 0.01% by mass or more and 1% by mass or less based on the total amount of the lubricating oil composition, preferably 0.05% by mass or more and 0.5% by mass or less.

The defoaming agent includes silicone oils, fluorosilicone oils, fluoroalkyl ethers, etc., and from the viewpoint of the balance between the defoaming effect and the economic potential, the blending amount thereof is generally 0.0005% by mass or more and 0.5% by mass or less based on the total amount of the lubricating oil composition, preferably 0.01% by mass or more and 0.2% by mass or less.

(Various Properties of Lubricating oil Composition)

The kinematic viscosity at 40° C. of the lubricating oil composition of the present invention is preferably 10 $mm^2/s$ or more and 70 $mm^2/s$ or less, more preferably 20 $mm^2/s$ or more and 60 $mm^2/s$ or less, even more preferably 25 $mm^2/s$ or more and 50 $mm^2/s$ or less. The kinematic viscosity at 100° C. of the lubricating oil composition of the present invention is preferably 6 $mm^2/s$ or more and 15 $mm^2/s$ or less, more preferably 6 $mm^2/s$ or more and 12 $mm^2/s$ or less, even more preferably 6 $mm^2/s$ or more and 11 $mm^2/s$ or less.

The viscosity index of the lubricating oil composition of the present invention is preferably 160 or more, more preferably 170 or more, even more preferably 180 or more.

Here, the measurement methods for the kinematic viscosity and the viscosity index are the same as those of the base oil mentioned hereinabove.

EXAMPLES

Next, the present invention is described in more detail with reference to Examples, but the present invention is not whatsoever restricted by these Examples.

Examples 1 to 5 and Comparative Examples 1 to 10

Lubricating oil compositions were prepared in the blending formulation (% by mass) shown in Table 1 and Table 2.

The properties thereof are shown in Table 1 and Table 2. The details of the components are as follows.

Base Oil A: poly-α-olefin (PAO), 100° C. kinematic viscosity: 2 $mm^2/s$, viscosity index: 117

Base Oil B: poly-α-olefin (PAO), 100° C. kinematic viscosity: 4 $mm^2/s$, viscosity index: 117

Base Oil C: poly-α-olefin (PAO), 100° C. kinematic viscosity: 100 $mm^2/s$, viscosity index: 117

Base Oil D: poly-α-olefin (PAO), 100° C. kinematic viscosity: 150 $mm^2/s$, viscosity index: 117

Base Oil E: ester base oil, 100° C. kinematic viscosity: 4 $mm^2/s$, viscosity index: 139

Base Oil F: mineral oil categorized as Group III of API base oil category, 100° C. kinematic viscosity: 2 $mm^2/s$, viscosity index: 116

Base Oil G: mineral oil categorized as Group III of API base oil category, 100° C. kinematic viscosity: 10 $mm^2/s$, viscosity index: 107

Viscosity Index Improver A: OCP (olefin copolymer): copolymer of ethylene and propylene, number average molecular weight: 2,600

Viscosity Index Improver B: OCP (olefin copolymer): copolymer of ethylene and propylene, number average molecular weight: 3,700

Viscosity Index Improver C: polymethacrylate, number average molecular weight: 50,000

Extreme-Pressure Additive A: mixture of sulfurized olefin and polysulfide (di-tert-butyl disulfide and di-tert-butyl trisulfide)

Extreme-Pressure Additive B: mixture of phosphite and thiophosphate

Extreme-Pressure Additive C: tricresyl phosphate

Dispersant A: boron-containing succinimide (boron-containing polybutenylsuccinic bisimide), number average molecular weight of polybutenyl group: 2,300, nitrogen content: 1.76% by mass, boron content: 1.45% by mass Dispersant B: boron-containing succinimide (boron-containing polybutenylsuccinic bisimide), number average molecular weight of polybutenyl group: 2,000, nitrogen content: 1.45% by mass, boron content: 1.3% by mass Friction Modifier A: ash-free modifier (oleic amide)

Friction Modifier B: molybdenum dithiocarbamate (MoDTC)

Other Additives: pour point depressant, antioxidant, defoaming agent, etc.

The properties of the synthetic oil, the mineral oil and the lubricating oil composition were measured according to the following methods.

(1) Kinematic Viscosity

According to JIS K 2283:2000, the kinematic viscosity at 40° C. and 100° C. was measured.

(2) Viscosity Index (VI)

The viscosity index was measured according to JIS K 2283:2000.

(3) Content of Boron Atom, Molybdenum Atom, Sulfur Atom and Phosphorus Atom

The contents of boron atom, molybdenum atom, sulfur atom and phosphorus atom were measured according to JIS-5S-38-92.

(4) Content of Nitrogen Atom

The content of nitrogen atom was measured according to JIS K2609:1998.

A base oil and various additives of the type shown in Table 1 and Table 2 were blended in the blending ratio also shown therein, thereby preparing lubricating oil compositions of Examples and Comparative Examples. The resultant lubricating oil compositions were tested according to the methods mentioned below to evaluate the physical properties thereof. The evaluation results are shown in Table 1 and Table 2.

[Shear Stability Test]

The decreasing rate (%) of the kinematic viscosity at 100° C. after shearing was measured according to JPI-5S-29-88 (ultrasonic wave, Method A, 60 minutes, 30 mL). A lower decreasing rate (%) indicates more excellent shear stability.

[Traction Coefficient]

The traction coefficient was measured with MTM Traction Measuring Equipment. A smaller traction coefficient indicates more excellent fuel saving properties.

The measurement conditions are as follows. (Applied load: 45 N, oil temperature: 20° C., slide/roll ratio: 50%, mean rotational speed: 1 m/s)

[Intermetallic Friction Coefficient]

Using a block-on-ring tester (LFW-1) and according to JASO M358:2005, the intermetallic friction coefficient was measured. The data measured under the following test condition were compared. A smaller friction coefficient indicates more excellent fuel saving properties.

Testing Tool

Ring: Falex S-10 Test Ring (SAE4620 Steel)

Block: Falex H-60 Test Block (SAE01 Steel)

Test Condition:

Temperature: 110° C.

Load: 1112 N

Sliding Speed: 0.5 m/s

[ISOT Test]

According to JIS K 2514-1:2013, a copper/iron catalyst was made to exist in the lubricating oil composition of Examples and Comparative Examples, and the lubricating oil composition was thus degraded at a test temperature of 150° C. for a test period of time of 120 hours. The kinematic viscosity at 100° C. of the degraded oil was referred to as $(\text{kinematic viscosity})_0$, and the kinematic viscosity at 100° C. of undegraded oil was referred to as $(\text{kinematic viscosity})_1$. The viscosity reduction rate $(=100-((\text{kinematic viscosity})_0, -(\text{kinematic viscosity})_1)\times 100/(\text{kinematic viscosity})_0)$ was calculated. A smaller value of viscosity reduction rate indicates a good lubricating oil composition hardly degradable and excellent in oxidation stability.

[Shell Four-Ball Test Load Bearing (EP) Test]

According to ASTM D2783-03 (2014), the test was carried out at a rotational number of 1800 rpm and at room temperature to measure the fusion load WL (N). A larger value of the measured data indicates more excellent load bearing properties (extreme-pressure properties).

[Shell Four-Ball Wear Test]

According to ASTM D4172-94 (2010), the test was carried out at 100° C., at 1800 rpm, at 392 N and for 60 minutes to measure the wear track diameter (mm). A smaller value of the measured data indicates more excellent wear resistance.

TABLE 1

| | | | Example | | | | |
|---|---|---|---|---|---|---|---|
| | | | 1 | 2 | 3 | 4 | 5 |
| Composition | Base Oil A | mass % | 50.00 | 55.70 | 61.55 | 64.00 | — |
| | Base Oil B | mass % | — | — | — | — | 69.75 |
| | Base Oil C | mass % | 28.30 | — | — | — | 8.00 |
| | Base Oil D | mass % | — | 28.10 | 25.00 | 20.00 | — |
| | Base Oil E | mass % | 5.00 | — | — | — | 5.00 |
| | Base Oil F | mass % | — | — | — | — | — |
| | Base Oil G | mass % | — | — | — | — | — |
| | Viscosity Index Improver A | mass % | 6.20 | 6.20 | — | — | 5.00 |
| | Viscosity Index Improver B | mass % | — | — | 3.00 | 3.00 | — |
| | Viscosity Index Improver G | mass % | — | — | — | — | — |
| | Extreme-Pressure Additive A | mass % | 4.00 | 4.00 | 4.50 | 4.00 | 4.00 |
| | Extreme-Pressure Additive B | mass % | 1.20 | 1.20 | 1.35 | 1.20 | 1.20 |
| | Extreme-Pressure Additive C | mass % | 1.00 | 0.50 | 0.10 | 1.00 | 1.00 |
| | Dispersant A | mass % | 1.60 | 1.60 | 1.80 | 1.60 | 1.60 |
| | Dispersant B | mass % | — | — | — | 2.00 | 2.00 |
| | Friction Modifier A | mass % | 0.50 | 0.50 | 0.50 | 0.50 | 0.50 |
| | Friction Modifier B | mass % | 0.50 | 0.50 | 0.50 | 1.00 | 0.25 |
| | Other Additives | mass % | 1.70 | 1.70 | 1.70 | 1.70 | 1.70 |
| | Total | mass % | 100.00 | 100.00 | 100.00 | 100.00 | 100.00 |
| Properties | Base Oil Viscosity (40° C. Kinematic Viscosity) | $mm^2/s$ | 20.66 | 19.41 | 16.18 | 13.42 | 22.96 |
| | Base Oil Viscosity (100° C. Kinematic Viscosity) | $mm^2/s$ | 4.72 | 4.79 | 4.04 | 3.56 | 4.81 |
| | Base Oil Viscosity Index | | 154 | 181 | 157 | 155 | 134 |
| | Composition Viscosity (40° C. Kinematic Viscosity) | $mm^2/s$ | 48.8 | 40.7 | 31.9 | 26.9 | 49.8 |
| | Composition Viscosity (100° C. Kinematic Viscosity) | $mm^2/s$ | 9.90 | 8.85 | 7.33 | 6.41 | 10.00 |
| | Composition Viscosity Index | — | 195 | 206 | 207 | 205 | 193 |
| | Boron (B) Content *1 | mass % | 0.023 | 0.023 | 0.026 | 0.049 | 0.049 |
| | Molybdenum (Mo) Content *2 | mass % | 0.020 | 0.020 | 0.020 | 0.040 | 0.010 |
| | Sulfur (S) Content *3 | mass % | 2.000 | 2.000 | 2.250 | 2.000 | 2.000 |
| | Phosphorus (P) Content *3 | mass % | 0.192 | 0.152 | 0.134 | 0.192 | 0.192 |
| | Nitrogen (N) Content *4 | mass % | 0.080 | 0.080 | 0.084 | 0.109 | 0.109 |
| | (B)/(Mo) | — | 1.15 | 1.15 | 1.30 | 1.23 | 4.90 |
| | (S)/(P) | — | 10.4 | 13.2 | 16.8 | 10.4 | 10.4 |
| Evaluation | Shear Stability | % | <3 | <3 | <3 | <3 | <3 |
| | Traction Coefficient | — | 0.04 | 0.04 | 0.04 | 0.04 | 0.04 |
| | Intermetallic Friction Coefficient | — | 0.07 | 0.07 | 0.05 | 0.04 | 0.06 |
| | Oxidation Stability (viscosity increase rate) | % | <5 | <5 | <5 | <5 | <5 |
| | Shell 4-Ball Test: EP (WL) | N | >3000 | >3000 | >3000 | >3000 | >3000 |
| | Shell 4-Ball Test: WEAR | mm | 0.40 | 0.41 | 0.44 | 0.43 | 0.42 |

TABLE 2

| | | | Comparative Example | | | | |
|---|---|---|---|---|---|---|---|
| | | | 1 | 2 | 3 | 4 | 5 |
| Composition | Base Oil A | mass % | — | 28.30 | 61.30 | 64.30 | 78.30 |
| | Base Oil B | mass % | — | — | — | 14.00 | — |
| | Base Oil C | mass % | — | — | — | — | — |
| | Base Oil D | mass % | — | — | 17.00 | — | — |
| | Base Oil E | mass % | 5.00 | 5.00 | 5.00 | 5.00 | 5.00 |
| | Base Oil F | mass % | 38.30 | — | — | — | — |
| | Base Oil G | mass % | 40.00 | 50.00 | — | — | — |
| | Viscosity Index Improver A | mass % | 6.20 | 6.20 | — | 6.20 | 6.20 |
| | Viscosity Index Improver B | mass % | — | — | — | — | — |
| | Viscosity Index Improver C | mass % | — | — | 6.20 | — | — |
| | Extreme-Pressure Additive A | mass % | 4.00 | 4.00 | 4.00 | 4.00 | 4.00 |
| | Extreme-Pressure Additive B | mass % | 1.20 | 1.20 | 1.20 | 1.20 | 1.20 |
| | Extreme-Pressure Additive C | mass % | 1.00 | 1.00 | 1.00 | 1.00 | 1.00 |
| | Dispersant A | mass % | 1.60 | 1.60 | 1.60 | 1.60 | 1.60 |
| | Dispersant B | mass % | — | — | — | — | — |
| | Friction Modifier A | mass % | 0.50 | 0.50 | 0.50 | 0.50 | 0.50 |
| | Friction Modifier B | mass % | 0.50 | 0.50 | 0.50 | 0.50 | 0.50 |
| | Other Additives | mass % | 1.70 | 1.70 | 1.70 | 1.70 | 1.70 |
| | Total | mass % | 100.00 | 100.00 | 100.00 | 100.00 | 100.00 |
| Properties | Base Oil Viscosity (40° C. Kinematic Viscosity) | $mm^2/s$ | 20.1 | 25.6 | 12.8 | 7.79 | 6.72 |
| | Base Oil Viscosity (100° C. Kinematic Viscosity) | $mm^2/s$ | 4.27 | 4.98 | 3.31 | 2.28 | 2.04 |
| | Base Oil Viscosity Index | | 119 | 122 | 133 | 104 | 93 |
| | Composition Viscosity (40° C. Kinematic Viscosity) | $mm^2/s$ | 39.3 | 43.4 | 39.6 | 23.8 | 20.8 |
| | Composition Viscosity (100° C. Kinematic Viscosity) | $mm^2/s$ | 7.34 | 7.82 | 9.02 | 5.74 | 5.20 |
| | Composition Viscosity Index | — | 154 | 152 | 219 | 199 | 199 |
| | Boron (B) Content *1 | mass % | 0.023 | 0.023 | 0.023 | 0.023 | 0.023 |

TABLE 2-continued

| | | | | | | | |
|---|---|---|---|---|---|---|---|
| | Molybdenum (Mo) Content *2 | mass % | 0.020 | 0.020 | 0.020 | 0.020 | 0.020 |
| | Sulfur (S) Content *3 | mass % | 2.000 | 2.000 | 2.000 | 2.000 | 2.000 |
| | Phosphorus (P) Content *3 | mass % | 0.192 | 0.192 | 0.192 | 0.192 | 0.192 |
| | Nitrogen (N) Content *4 | mass % | 0.080 | 0.080 | 0.080 | 0.080 | 0.080 |
| | (B)/(Mo) | — | 1.15 | 1.15 | 1.15 | 1.15 | 1.15 |
| | (S)/(P) | — | 10.4 | 10.4 | 10.4 | 10.4 | 10.4 |
| Evaluation | Shear Stability | % | <3 | <3 | 10 | <3 | <3 |
| | Traction Coefficient | — | 0.08 | 0.07 | 0.04 | 0.04 | 0.04 |
| | Intermetallic Friction Coefficient | — | 0.07 | 0.07 | 0.07 | 0.07 | 0.07 |
| | Oxidation Stability (viscosity increase rate) | % | <5 | <5 | <5 | 10 | 12 |
| | Shell 4-Ball Test: EP (WL) | N | >3000 | >3000 | >3000 | >3000 | >3000 |
| | Shell 4-Ball Test: WEAR | mm | 0.42 | 0.44 | 0.43 | 0.42 | 0.43 |

| | | | Comparative Example | | | | |
|---|---|---|---|---|---|---|---|
| | | | 6 | 7 | 8 | 9 | 10 |
| Composition | Base Oil A | mass % | — | 51.00 | 51.40 | 51.30 | 50.50 |
| | Base Oil B | mass % | 71.00 | — | — | — | — |
| | Base Oil C | mass % | 8.90 | 28.40 | 28.50 | 28.50 | 29.10 |
| | Base Oil D | mass % | — | — | — | — | — |
| | Base Oil E | mass % | 5.00 | 5.00 | 5.00 | 5.00 | 5.00 |
| | Base Oil F | mass % | — | — | — | — | — |
| | Base Oil G | mass % | — | — | — | — | — |
| | Viscosity Index Improver A | mass % | 5.00 | 6.20 | 6.20 | 6.20 | 6.20 |
| | Viscosity Index Improver B | mass % | — | — | — | — | — |
| | Viscosity Index Improver C | mass % | — | — | — | — | — |
| | Extreme-Pressure Additive A | mass % | 4.00 | 4.00 | 4.00 | 2.50 | 4.00 |
| | Extreme-Pressure Additive B | mass % | 1.20 | 1.20 | 1.20 | 1.20 | 0.90 |
| | Extreme-Pressure Additive C | mass % | 1.00 | 1.00 | 1.00 | 1.00 | 0.00 |
| | Dispersant A | mass % | 1.60 | — | — | 1.60 | 1.60 |
| | Dispersant B | mass % | — | 0.50 | 0.50 | — | — |
| | Friction Modifier A | mass % | 0.50 | 0.50 | 0.50 | 0.50 | 0.50 |
| | Friction Modifier B | mass % | 0.10 | 0.50 | — | 0.50 | 0.50 |
| | Other Additives | mass % | 1.70 | 1.70 | 1.70 | 1.70 | 1.70 |
| | Total | mass % | 100.00 | 100.00 | 100.00 | 100.00 | 100.00 |
| Properties | Base Oil Viscosity (40° C. Kinematic Viscosity) | $mm^2/s$ | 23.5 | 20.4 | 20.3 | 20.3 | 21.0 |
| | Base Oil Viscosity (100° C. Kinematic Viscosity) | $mm^2/s$ | 4.80 | 4.72 | 4.72 | 4.72 | 4.72 |
| | Base Oil Viscosity Index | | 128 | 159 | 160 | 160 | 150 |
| | Composition Viscosity (40° C. Kinematic Viscosity) | $mm^2/s$ | 49.8 | 48.7 | 48.7 | 48.7 | 48.7 |
| | Composition Viscosity (100° C. Kinematic Viscosity) | $mm^2/s$ | 10.00 | 9.89 | 9.89 | 9.89 | 9.89 |
| | Composition Viscosity Index | — | 193 | 195 | 195 | 195 | 195 |
| | Boron (B) Content *1 | mass % | 0.023 | 0.007 | 0.007 | 0.023 | 0.023 |
| | Molybdenum (Mo) Content *2 | mass % | 0.004 | 0.020 | 0.000 | 0.020 | 0.020 |
| | Sulfur (S) Content *3 | mass % | 2.000 | 2.000 | 2.000 | 1.250 | 2.000 |
| | Phosphorus (P) Content *3 | mass % | 0.192 | 0.192 | 0.192 | 0.192 | 0.084 |
| | Nitrogen (N) Content *4 | mass % | 0.080 | 0.059 | 0.059 | 0.080 | 0.080 |
| | (B)/(Mo) | — | 5.75 | 0.35 | — | 1.15 | 1.15 |
| | (S)/(P) | — | 10.4 | 10.4 | 10.4 | 6.5 | 23.8 |
| Evaluation | Shear Stability | % | <3 | <3 | <3 | <3 | <3 |
| | Traction Coefficient | — | 0.04 | 0.04 | 0.04 | 0.04 | 0.04 |
| | Intermetallic Friction Coefficient | — | 0.09 | 0.10 | 0.11 | 0.07 | 0.07 |
| | Oxidation Stability (viscosity increase rate) | % | <5 | <5 | <5 | <5 | <5 |
| | Shell 4-Ball Test: EP (WL) | N | >3000 | >3000 | >3000 | 2452 | >3000 |
| | Shell 4-Ball Test: WEAR | mm | 0.41 | 0.45 | 0.44 | 0.39 | 0.69 |

Notes) *1 to *4 in Table 1 and Table 2 are as follows.

*1: The boron (B) content is a boron atom-equivalent content of the boron-containing dispersant (the boron atom content contained in the boron-containing dispersant) based on the total amount of the composition.

*2: The molybdenum (Mo) content is a molybdenum atom-equivalent content of the molybdenum-based friction modifier (the molybdenum atom content contained in the molybdenum-based friction modifier) based on the total amount of the composition.

*3: The sulfur (S) content and the phosphorus (P) content are the total content of the sulfur atoms and the total content of the phosphorus atoms contained in the extreme-pressure additive used.

*4: The nitrogen (N) content is the total amount of the nitrogen content in the dispersant and the nitrogen (N) fraction (0.052% by mass) contained in the antioxidant in the other additive.

INDUSTRIAL APPLICABILITY

The lubricating oil composition of the present invention is a lubricating oil composition satisfying both fuel saving properties and extreme-pressure properties, and having shear stability, oxidation stability and wear resistance, and is, in particular, favorably used for gear systems, for example, for gear oil for automobiles, industrial gear oil, etc., and is especially favorably used for lubrication for differential gearing in automobiles.

The invention claimed is:

1. A lubricating oil composition, comprising:

60% by mass or more and 99% by mass or less of a base oil;

0.5% by mass or more and 15% by mass or less of a viscosity index improver;

0.05% by mass or more and 5% by mass or less of a molybdenum-based friction modifier;

0.1% by mass or more and 10% by mass or less of a boron-containing dispersant; and 0.5% by mass or more and 10% by mass or less of a sulfur-based extreme-pressure additive, 0.1% by mass or more and 10% by mass or less of a phosphorous-based extreme-pressure additive and 0.5% by mass or more and 10% by mass or less of a sulfur/phosphorus-based extreme-pressure additive, wherein:

the base oil is a mixture of synthetic oils comprising a synthetic oil having a kinetic viscosity at 100° C. of from 100 $mm^2/s$ to 150 $mm^2/s$;

the mixture of synthetic oils is selected from the group consisting of polyphenyl ethers, alkylbenzenes, alkylnaphthalenes, ester oils, glycol-based oils and polyolefin-based oils, a kinematic viscosity of the base oil mixture at 100° C. is 3 $mm^2/s$ or more and 10 $mm^2/s$ or less;

the viscosity index improver is a resin having a number average molecular weight (Mn) of 1,000 or more and 10,000 or less;

a mass ratio of boron atoms (B) contained in the boron-containing dispersant to molybdenum atoms (Mo) contained in the molybdenum-based friction modifier, [(B)/(Mo)] is 1 or more and 5 or less;

a mass ratio of sulfur atoms (S) to phosphorus atoms (P) contained in the extreme-pressure additive(s), [(S)/(P)] is 13.2 to 20;

the lubricating oil composition has a viscosity index of 160 or more;

the lubricating oil composition has a kinematic viscosity at 40° C. of 31.9 to 49.8 $mm^2/s$, and the lubricating oil composition has a kinematic viscosity at 100° C. of 7.33 to 10.0 $mm^2/s$.

2. The lubricating oil composition according to claim 1, which has a kinematic viscosity at 100° C. of 6 $mm^2/s$ or more and 15 $mm^2/s$ or less.

3. The lubricating oil composition according to claim 1, wherein a boron atom-equivalent content of the boron-containing dispersant based on a total amount of the composition is 0.01% by mass or more and 0.1% by mass or less.

4. The lubricating oil composition according to claim 1, wherein a molybdenum atom-equivalent content of the molybdenum-based friction modifier based on a total amount of the composition is 0.005% by mass or more and 0.1% by mass or less.

5. The lubricating oil composition according to claim 1, wherein a sulfur atom content based on a total amount of the composition is 1.5% by mass or more and 5% by mass or less.

6. The lubricating oil composition according to claim 1, wherein a phosphorus atom content based on a total amount of the composition is 0.1% by mass or more and 0.5% by mass or less.

7. The lubricating oil composition according to claim 1, wherein the viscosity index improver is an olefinic copolymer.

8. The lubricating oil composition according to claim 1, wherein the molybdenum-based friction modifier is at least one selected from the group consisting of molybdenum dithiocarbamate, molybdenum dithiophosphate and an amine salt of molybdic acid.

9. The lubricating oil composition according to claim 1, wherein the boron-containing dispersant is a boron-containing succinimide.

10. A lubricating oil composition for gear oil comprising the lubricating oil composition according to claim 1.

* * * * *